United States Patent [19]

Mori et al.

[11] 3,963,270

[45] June 15, 1976

[54] APPARATUS FOR LIFTING UP AND CARRYING CONCRETE POLES

[75] Inventors: Takumitsu Mori, Hachioji; Masao Tanaka, Kamakura, both of Japan

[73] Assignee: Nippon Concrete Industries Co. Ltd., Tokyo, Japan

[22] Filed: Dec. 30, 1974

[21] Appl. No.: 537,371

[52] U.S. Cl. ..... 294/81 R

[51] Int. Cl.[2] ..... B66C 1/62

[58] Field of Search ..... 294/67 R, 67 BA, 67 B, 294/67 BB, 81 R, 86 R, 87 R, 91, 92, 106, 113; 214/1 P, 1 PA, 1 PB, 2.5, 3, 3.1, 147 R, 147 AS, DIG. 3, DIG. 4

[56] References Cited

UNITED STATES PATENTS

| | | | |
|---|---|---|---|
| 1,877,974 | 9/1932 | Robb | 214/1 PA |
| 2,692,159 | 10/1954 | Croswell et al. | 294/81 R |
| 3,112,830 | 12/1963 | Podlesak | 214/3 |
| 3,529,731 | 9/1970 | Penny | 294/81 R X |
| 3,561,615 | 2/1971 | Forsberg et al. | 214/1 P |
| 3,561,810 | 2/1971 | Newsted | 294/81 R |

*Primary Examiner*—Evon C. Blunk
*Assistant Examiner*—Johnny D. Cherry
*Attorney, Agent, or Firm*—Oblon, Fisher, Spivak, McClelland & Maier

[57] ABSTRACT

This invention relates to an apparatus for lifting up and carrying concrete poles characterized by comprising beams to be lifted up by a crane or the like, cylinders which are respectively provided under each beam at certain intervals and which section has a downward C-shape and further which inner surface is formed into a taper same as that of a pole so that the cylinders can lift up the pole by adhereing to the pole at determined positions, and a safety confirmation equipment to confirm the adhered condition; and the object of the invention is to lift up and carry long tapered concrete poles safely, surely and efficiently.

9 Claims, 9 Drawing Figures

APPARATUS FOR LIFTING UP AND CARRYING CONCRETE POLES

SUMMARY OF THE INVENTION

This invention relates to an apparatus for lifting up and carrying concrete poles.

Hitherto a concrete pole has been lifted up by using hooks of a special shape which suit a sectional shape of a pole or by directly hanging a pole itself with a wire rope. However in the case of a wire rope, men are required for putting a rope around a pole and it is dangerous for workers. In the case of hooks, it is required to put hooks between each pole, so that a wide distance between each pole is required, and further some kind of hook needs an equipment for turning the hook to the lower part of a pole. Moreover in case the width of a hook is narrow, a device for preventing damage to the surface of a product is required.

The first object of the present invention is to provide a beam for lifting up a long article having a predetermined taper like a concrete pole by adhering some cylinders which section has a C-shape to the periphery of a pole without using hooks in order to eliminate the above defects. The second object of the present invention is to provide a safety confirmation equipment for lifting up and carrying a pole safely and surely.

The other objects and the features of the present invention will be apparent by the following embodiments.

BRIEF DESCRIPTION OF THE DRAWINGS

FIG. 6 (B) is a sectional view taken along the line VIB — VIB of FIG. 6 (A);

FIG. 7 (B) is a partial enlarged front elevation view showing the part in FIG. 7 (A).

DETAILED DESCRIPTION OF THE INVENTION

Figure 1:
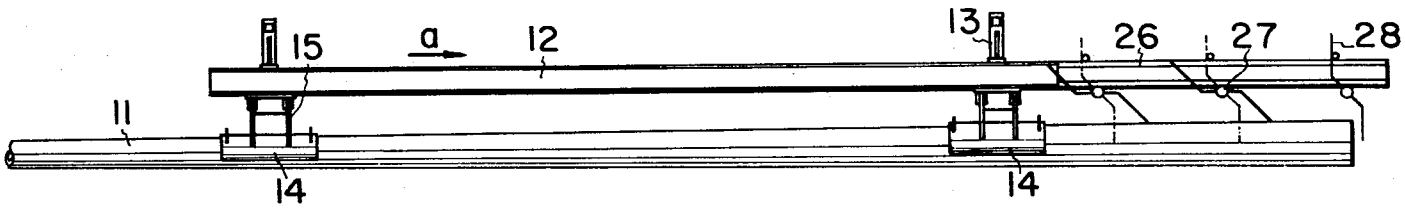
FIG. 1 is a front elevation view showing the condition of lifting up a pole in the first embodiment of the present invention.

FIG. 1 is a front elevation view in the first embodiment of the present invention showing the apparatus for lifting up a pole; in which reference numeral 11 designates a concrete pole, 12 designates a beam of a channel steel, an I-steel or the like, and 13 designates a bracket which is protruding beyond the upper surface of the beam and is directly lifted up by a hook of a crane (not shown in the drawing). 14 designates a cylinder which has a taper shape which is about the same as that of the pole 11 and which section has a C-shape. Concrete construction is shown in an enlarged front elevation view of FIG. 3 and in a side elevation view of FIG. 4.

Namely one or more than two cylinders 14 are provided under the beam 12 at determined intervals in the manner that the opening side of the C-shape cylinder is positioned at the lower side. 15 designates cylinder holding plates which are provided protruding beyond the upper surface of the cylinder 14. The top of the plate 15 is supported in the freely swingable manner by a bracket 17 which is attached to the lower surface of the beam 12 through a pin 16. Consequently the cylinders 14 are supported under the beam 12 and along the beam, and thereby when the cylinders 14 are descended, the cylinders 14 can move corresponding to the position of the pole 11. Moreover the inner diameter of each cylinder 14 is different at each position according to the change of the diameter of the tapered pole 11.

Figure 3:
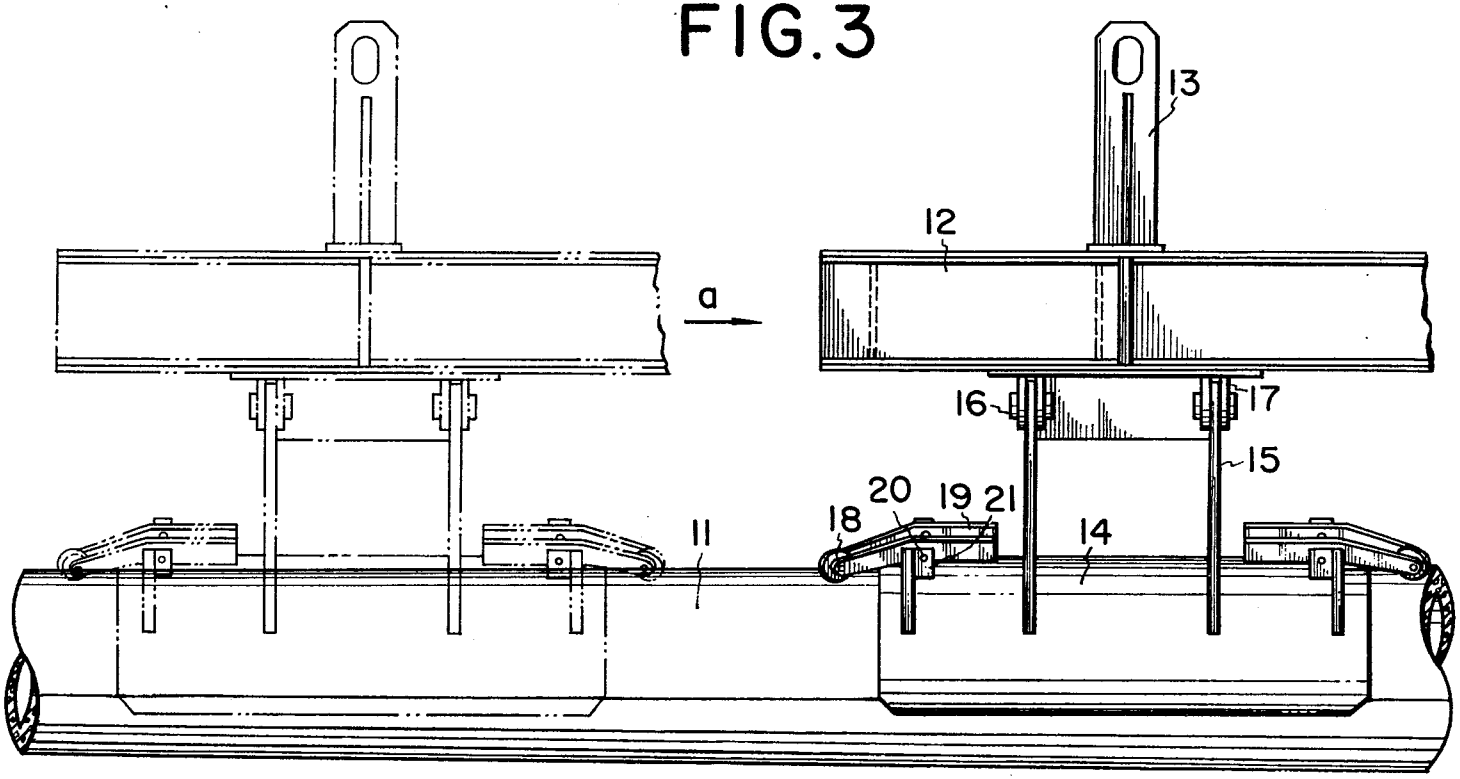
FIG. 3 is an enlarged front elevation view showing the operating condition of a main part of the apparatus in the first and second embodiments.
Figure 4:
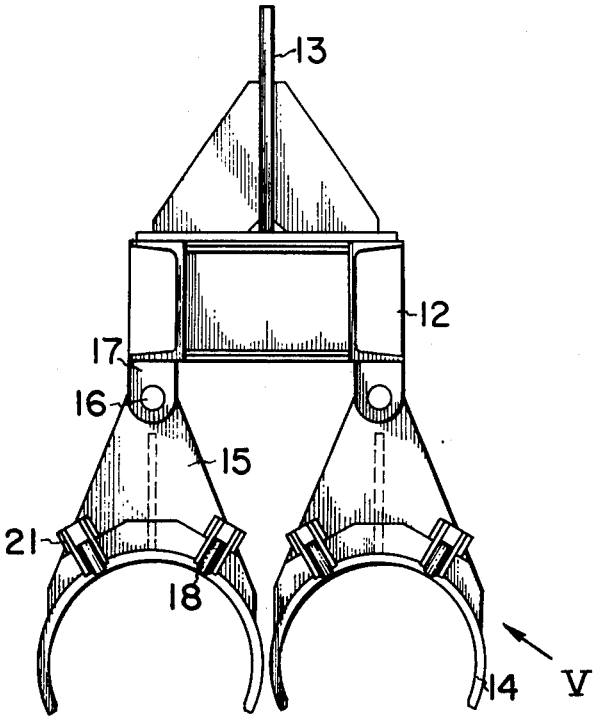
FIG. 4 is an enlarged side elevation view.

As shown in FIG. 3, the cylinder 14 is descended and put on the small diameter part of the pole 11, and the cylinder 14 is moved on the pole horizontally toward the large diameter part (in the direction of arrow *a*) together with the beam 12 by a crane or the like and stops at the position where the inner diameter of the cylinder 14 is approximately the same as the diameter of the pole 11. Therefore the inner surface of the cylinder 14 is adhered to the periphery of the pole 11 and when the crane is wound up, the pole 11 is lifted up by the friction of the contacted surfaces, especially of the lower end inner surface of the cylinder 14 and the surface of the pole 11.

Figure 5:
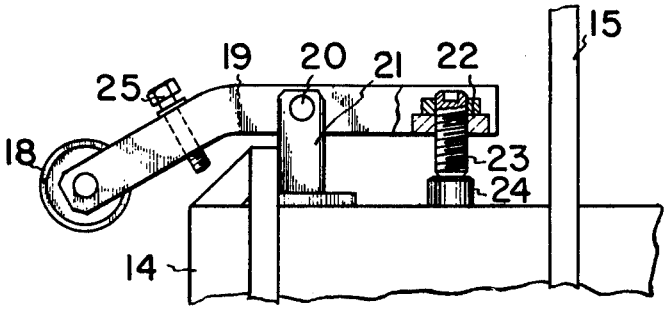
FIG. 5 is a partly sectional enlarged view observed in the direction of arrow V in FIG. 4.

18 designates contacting rollers for smoothly moving the cylinder 14 on the pole 11 by contacting with the upper surface of the pole 11 and for securing the contact of the lower end inner surface of the cylinder 14 and the pole 11. As shown in a partial enlarged view of FIG. 5, the contacting rollers 18 are supported at the forward ends of arms 19 which are supported in the freely rotatable manner at both ends of the upper surface of the cylinder 14. 20 designates a pin for supporting the arm 19, and 21 designates a bracket for supporting the pin 20.

A rib 22 is attached to the rear end of the arm 19, and a set bolt 23 is screwed through the rib 22 and protrudes beyond the lower surface of the arm 19 so as to contact a protuberance 24 provided on the upper surface of the cylinder 14, and thereby the upper end position of the contacting roller 18 can be adjusted. 25 designates a set bolt screwed through the forward part of the arm 19 to adjust the lower end position of the contacting roller 18.

Next a few examples of an equipment for confirming the safety before lifting up a pole will be explained. First in the first embodiment shown in FIG. 1, a supplementary beam 26 which is relatively light in weight is connected with the end (a side of the large diameter part of a pole) of the beam 12. Confirmation levers 28 are supported at the lower part of the supplementary beam 26 at determined intervals and they are standing in the normal condition. The central part of the lever 28 is supported by a shaft 27 so that it is fallen down contacting the lower end with the upper surface of the pole 11.

Figure 6:
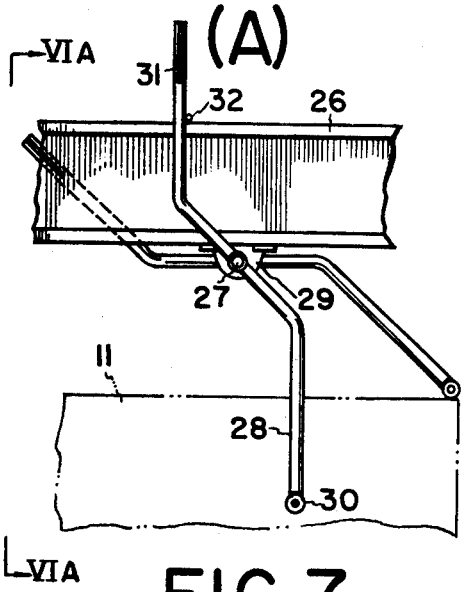
FIG. 6 (A) is a partial enlarged front elevation view showing a safety confirmation equipment in the first embodiment.
Figure 6:
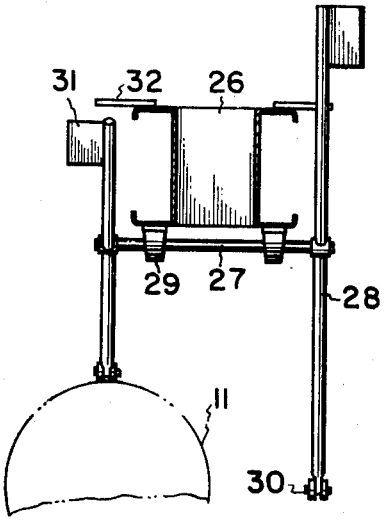

The detail of the present equipment is shown in a front elevation view of FIG. 6 (A) and a sectional view of FIG. 6 (B). The shaft 27 is supported at the lower part of the supplementary beam 26 by a supporter 29 crossing under the beam. The lever 28 is provided with a contacting roller 30 at the lower end and a plate 31 at the upper end by which the undulation of the lever 28 is easily confirmed. 32 designates a stopper provided protruding beyond the side of the supplementary beam 26 to prevent the lever 28 from falling down too far in order to keep the lever 28 standing in a certain position.

The lower ends of the levers 28 contact with the upper surface of the correctly set, the adhered conditon of 11 and fall down at the time the beam 12 is descended toward the pole 11. When the beam 12 is moved to the large diameter side of the pole 11, the levers 28 are removed from the upper surface of the pole 11 in order from the end one. Therefore how many levers 28 are standing can be easily confirmed with the naked eye or by a switch (not shown in the drawing) to perceive the turning of the lever 28. Consequently if the smallest diameter and the taper of the pole 11 is known and the positions of attaching the levers 28 are correctly et, the adhered condition of the pole 11 and the inner surfaces of the cylinders 14 is confirmed and the danger that the pole 11 drops at the time it is lifted up is prevented.

Figure 2:
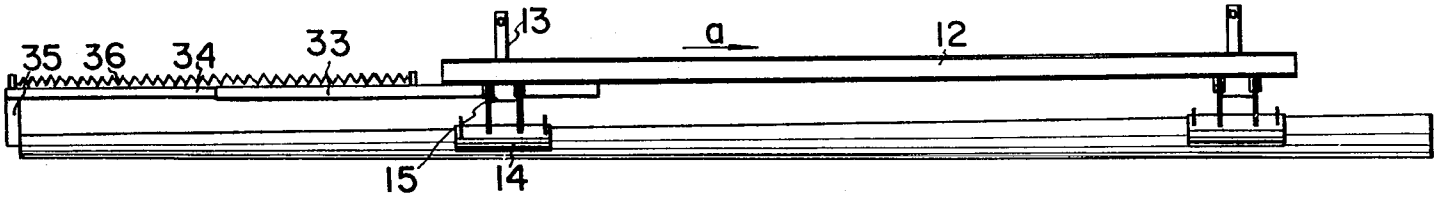
FIG. 2 is a front elevation view showing the condition of lifting up a pole in the second embodiment of the present invention.

In the second embodiment shown in FIG. 2, a long case 33 is fixed to the end (the small diameter side of the pole) of the beam 12. A long rod 34 is inserted into the case 33 in the manner it can freely slide out of the case 33 and the rod 34 is provided with a jaw 35 facing downward at the end (the small diameter side of the pole). 36 designates a coil spring provided between the case 33 and the rod 34 and the spring 36 has a function of pushing back the rod 34 protruded beyond the case 33 in the direction of the beam 12. It is also possible to put the spring 36 inside the case 33.

In the construction as described hereinbefore, when the cylinders 14 are moved on the pole 11 toward the large diameter side of the pole 11 for a certain distance, the lower end of the jaw 35 contacts with the smallest diameter part of the pole 11 and according to the movement of the beam 12 the rod 34 protrudes beyond the case 33. By measuring the protruded distance of the rod 34 with a scale, similarly to the case in the first embodiment, it is understood whether the cylinder 14 reached the position where the inner part of the cylinder is adhered to the pole 11 or not.

Figure 7:
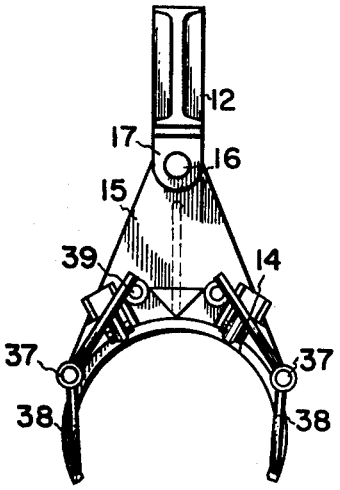
FIG. 7 (A) is an enlarged side elevation view showing a main part of the apparatus in the third embodiment.
Figure 7:
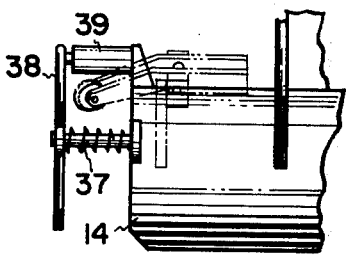

In the third embodiment shown in a side elevation view of FIG. 7 (A) and a front elevation view of FIG. 7 (B), pole diameter detecting devices are provided at both ends or one end of the cylinder 14. Namely shafts 37 are provided at both ends or one end of each cylinder 14 or specified cylinders 14. At each end two shafts are provided extending in the axial direction of the pole 11 symmetrically relating to the center of the inner diameter of each cylinder 14. Detecting levers 38 which are bending symmetrically with a certain angle are supported by the shafts 37, and the lower parts of the levers 38 are placed at the inner side of the inner surface of the cylinder 14 so as to be able to respectively contact with the front and back surfaces of the pole 11. The upper ends of the levers 38 contact with limit switches 39 which are provided at the upper part of the cylinder 14 symmetrically relating to the center of the cylinder or shut off the light of a phototube or the like.

In this embodiment, the inner surface of the cylinder 14 is contacting with the periphery of the pole 11 while the cylinder 14 is moving toward the large diameter side of the pole 11. The contacting condition is detected by the turning of the levers 38 provided on the cylinder 14 to contact with the pole 11. The forward end of the lever 38 works the limit switch 39 to issue a signal of sound, light or the like in order to inform the contacting condition of the cylinder 14 and the pole 11.

FIG. 7 (A) shows the example in which the apparatus is provided with only one beam and one cylinder is set at each determined position.

Various modifications are possible within the scope of the present invention. For example the numbers of upper bracket, beam and cylinder can be optionally decided as required, and various sizes of cylinders are prepared according to the standards of poles and any of them can be freely attached to a beam and removed to be exchanged.

We claim:

1. Apparatus for lifting up and carrying concrete poles which are tapered in the longitudinal direction so as to define small diameter end portions of said poles and large diameter end portions of said poles, comprising:

a longitudinal beam; and a plurality of cylindrical members dependingly supported from said beam and spaced along said beam in the longitudinal direction, at predetermined positions thereof, so as to define predetermined distances between successive cylindrical members;

each of said cylindrical members being substantially C-shaped in cross-section with the open portion thereof disposed downwardly, the arms of said C-shaped cylindrical members being integral with each other, so as to define one-piece cylindrical members, and of different sizes so as to define different sized internal open areas, corresponding to different sized outer diameter cross-sectional portions of said poles, at said predetermined positions thereof, whereby said beam and said cylindrical members are mounted upon said poles so as to lift and carry the same by moving said beam and cylindrical members longitudinally of said poles from the small diameter end portion toward the large diameter end portion, said cylindrical members gripping said poles when said particularly sized cylindrical members correspond to the particularly sized cross-sectional portions of said poles at said predetermined positions thereof.

2. Apparatus as set forth in claim 1, further comprising:

bracket means mounted upon the upper portion of said beam for facilitating said lifting and carrying of said beam, said cylindrical members, and said poles by means of a crane-type lifting device.

3. Apparatus as set forth in claim 1, wherein:

said cylinders are pivotably supported upon said beam so as to be pivotable in the transverse direction perpendicular to the longitudinal axis of said beam.

4. Apparatus as set forth in claim 1, further comprising:

roller means pivotably supported upon the upper portions of said cylindrical members for contacting the upper portions of said poles in order to facilitate the slidable mounting of said cylindrical members upon said poles.

5. Apparatus as set forth in claim 4, wherein:

said roller means are mounted upon arms pivotably supported upon both ends of said cylindrical members; and stop means are operatively associated with said roller means for limiting the range of inclination of said roller means.

6. Apparatus as set forth in claim 1, further comprising:

safety confirmation means for confirming the fact that the poles are properly disposed within said cylindrical members, whereby said lifting and carrying of said poles can be performed in a safe manner.

7. An apparatus for lifting up and carrying concrete poles, as claimed in claim 6, wherein said safety confirmation means comprises:

a supplementary beam which is relatively light in weight and which is connected with one end of said beam which corresponds to said large diameter end of said pole and levers supported in a freely rotatable manner at the lower part of the said supplementary beam, the top of which undulates depending upon whether the lower ends of the levers are in contact with the pole or not.

8. An apparatus for lifting up and carrying concrete poles, as claimed in claim 6, wherein said safety confirmation means comprises:

a long case fixed to one end of said beam which corresponds to said small diameter end of said pole, a long rod inserted inside said case in a manner such that it can freely slide out of the case, a jaw disposed downwardly and provided at one end of said rod corresponding to said small diameter end of said pole, and a spring provided between said long case and said long rod.

9. An apparatus for lifting up and carrying concrete poles, as claimed in claim 6, wherein said safety confirmation means comprises:

shafts provided at both sides of one end of said cylinders extending along said pole and symmetrically relative to the center of said cylinders, detecting levers supported by said shafts in a freely rotatable manner so that one end of the levers respectively contact the front and back side surfaces of the pole, and switches for detecting the rotation of said detecting levers.

* * * * *